US008557376B2

(12) United States Patent
Matsumura et al.

(10) Patent No.: US 8,557,376 B2
(45) Date of Patent: Oct. 15, 2013

(54) POLISHING PAD

(75) Inventors: Yasushi Matsumura, Tokyo (JP); Masataka Takagi, Tokyo (JP)

(73) Assignee: Fujibo Holdings Inc., Tokyo (JP)

( * ) Notice: Subject to any disclaimer, the term of this patent is extended or adjusted under 35 U.S.C. 154(b) by 834 days.

(21) Appl. No.: 12/678,207

(22) PCT Filed: Sep. 24, 2008

(86) PCT No.: PCT/JP2008/067165
§ 371 (c)(1),
(2), (4) Date: Mar. 15, 2010

(87) PCT Pub. No.: WO2009/041422
PCT Pub. Date: Apr. 2, 2009

(65) Prior Publication Data

US 2010/0210197 A1 Aug. 19, 2010

(30) Foreign Application Priority Data

Sep. 28, 2007 (JP) ..... 2007-253636

(51) Int. Cl.
*B32B 3/26* (2006.01)
*B24D 11/02* (2006.01)

(52) U.S. Cl.
USPC ..... 428/316.6; 428/318.8; 428/319.3; 451/533

(58) Field of Classification Search
USPC ..... 428/316.6, 318.8, 319.3; 451/533
See application file for complete search history.

(56) References Cited

U.S. PATENT DOCUMENTS

| | | | | |
|---|---|---|---|---|
| 6,884,156 | B2 * | 4/2005 | Prasad et al. | 451/533 |
| 8,167,690 | B2 * | 5/2012 | Fukuda et al. | 451/533 |
| 2006/0002283 | A1 * | 1/2006 | Horisaka et al. | 369/272.1 |
| 2006/0229000 | A1 * | 10/2006 | Izumi et al. | 451/41 |

FOREIGN PATENT DOCUMENTS

| | | | |
|---|---|---|---|
| JP | 2000-176825 | A | 6/2000 |
| JP | 2002-307293 | A | 10/2002 |
| JP | 2004-323679 | A | 11/2004 |
| JP | 2006-187838 | A | 7/2006 |
| JP | 2006-527923 | A | 12/2006 |
| JP | 2007-31883 | A | 2/2007 |

OTHER PUBLICATIONS

Hardness Conversion Chart, 3 pages, Jan. 20, 2013, http://www.carbidedepot.com/formulas-hardness.htm.*

International Search Report for PCT/JP2008/067165 mailed Dec. 2, 2008.

* cited by examiner

*Primary Examiner* — Hai Vo

(74) *Attorney, Agent, or Firm* — Roberts Mlotkowski Safran & Cole, P.C.

(57) ABSTRACT

A polishing pad which suppresses occurrence of a scratch or a roll-off on an object to be polished so that flatness is improved is provided. A polishing pad 1 is comprised a polyurethane sheet 2 having a polishing surface P for performing polishing processing to an object to be polished and an elastic sheet 3 having elasticity joined on a surface of the polyurethane sheet 2 on the opposite side to the polishing surface P. The polyurethane sheet 2 is set higher in compressibility than the elastic sheet 3, and is set lower in A hardness than the elastic sheet 3. The elastic sheet 3 is set at 1% or more in compressibility, and is set at 90 degrees or less in A hardness. Further, both of the polyurethane sheet 2 and the elastic sheet 3 are formed to have a thickness of 0.2 mm or more. The flexibility of the polyurethane sheet 2 is exerted during polishing processing so that the polyurethane sheet 2 deforms to press the polishing surface P approximately evenly on the object to be polished.

9 Claims, 1 Drawing Sheet

POLISHING PAD

FIELD OF THE INVENTION

The present invention relates to a polishing pad, and in particular to a polishing pad comprising a flexible plastic sheet having a polishing surface for performing polishing processing to an object to be polished and an elastic body joined on a surface of the flexible plastic sheet on the opposite side to the polishing surface.

DESCRIPTION OF THE RELATED ART

Conventionally, a polishing pad is used for polishing processing to a material (object to be polished) requiring high-precision flatness, such as an optical material such as a lens, a plane parallel plate, a reflective mirror or the like, a substrate for a hard disk, a silicon wafer for a semiconductor, a glass substrate for a liquid crystal display, or the like. As the polishing pad, for example, a polishing pad provided with a flexible or hard plastic sheet can be cited.

Ordinarily, the flexible plastic sheet is produced by applying resin solution obtained by dissolving a flexible plastic with a water-miscible organic solvent on a sheet-like base material and thereafter coagulating to form resin in aqueous coagulation liquid (produced by wet-type film formation). Therefore, since the flexible plastic sheet produced by wet-type film formation has a foamed structure accompanying the coagulation for formation of resin, polishing processing can be performed while polishing liquid is accumulated. However, since a polishing pad of this type has flexibility and deforms easily, a roll-off that a peripheral edge portion of the object to be polished is subjected to polishing processing more than the central portion thereof is likely to occur, so that flatness is lowered. In addition, if the hard plastic sheet is used in place of the flexible plastic sheet, a scratch (damage) is likely to occur on the surface of the object to be polished by polishing particles in the polishing liquid used in polishing processing.

In order to suppress the occurrence of a roll-off or a scratch on the object to be polished, techniques to produce a polishing pad with a two-layer structure or three-layer structure have been disclosed. For example, JPA-2000-176825 has disclosed a technique to produce a polishing pad having a surface layer with a thickness of 100 μm or less and a second layer on the back surface of the surface layer, the surface layer being more flexible than the second layer. JPA-2002-307293 has also disclosed a technique to produce a polishing pad having a surface layer with a thickness of 0.2 to 2.0 mm and a modulus of compression elasticity of 50% to 4%, a middle support layer with a thickness of 0.2 to 2.0 mm and a modulus of compression elasticity of 2% to 0.1% laminated on the side of the back surface of the surface layer, and a back surface layer with a thickness of 0.15 to 2.0 mm and a modulus of compression elasticity of 50% to 4% laminated on the side of the back surface of the middle support layer.

In the technique in JPA-2000-176825, however, suppression of occurrence of a scratch in polishing processing can be expected from the fact that the surface layer is made more flexible than the second layer, but since the thickness of the surface layer is 100 μm or less, which is too thin, flexibility of the surface layer is not sufficiently exerted. Therefore, it is insufficient to suppress scratch occurrence on an object to be polished requiring high-precision flatness, and thus it is difficult to satisfy the demand for flatness. On the other hand, the technique in JPA-2002-307293 is effective in improvement in roll-off, but the hardness of the middle support layer is too high, and thus there is the possibility that a scratch occurs during polishing processing. In addition, since the middle support layer cannot absorb a recess or a protrusion, if any, on a surface plate, the back surface layer having elasticity is laminated in order not to spoil flatness of the object to be polished. In such a polishing pad with a three-layer structure, there is such a problem that production process is complicated and troublesome, and thus it is unavoidable to increase costs.

SUMMARY OF THE INVENTION

In view of the above circumstances, a problem to be solved by the present invention is to provide a polishing pad which suppresses occurrence of a scratch or a roll-off on an object to be polished so that flatness can be improved.

In order to solve the above problem, according to the present invention, there is provided a polishing pad comprising a flexible plastic sheet having a polishing surface for performing polishing processing to an object to be polished and an elastic body joined on a surface of the flexible plastic sheet on the opposite side to the polishing surface, wherein the flexible plastic sheet has a higher compressibility and a lower A hardness than those of the elastic body, and the elastic body is 1% or more in compressibility and 90 degrees or less in A hardness, and wherein both the flexible plastic sheet and the elastic body are 0.2 mm or more in thickness.

In the present invention, since the flexible plastic sheet has a higher compressibility and a lower A hardness than those of the elastic body and its thickness is 0.2 mm or more, and thus flexibility of the flexible plastic sheet is exerted during polishing processing, occurrence of a scratch (damage) on an object to be polished can be suppressed, and since the compressibility of the elastic body is set at 1% or more, the A hardness thereof is set at 90 degrees or less and the thickness thereof is set at 0.2 mm or more, and thus a recess or a protrusion on the surface of a surface plate on which the polishing pad is attached, if any, can be absorbed by the elastic body, and the soft flexible plastic sheet is supported by the elastic body during the polishing processing so that pressure on the object to be polished is made even, occurrence of a roll-off on the object to be polished is suppressed so that flatness can be improved.

In this case, if the compressibility of the elastic body exceeds 25% and the A hardness thereof is less than 30 degrees, the elastic body is too flexible to exert the function of supporting the flexible plastic sheet, therefore it is preferable to set the compressibility of the elastic body at 25% or less and the A hardness thereof at 30 degrees or more. At this time, it is possible to set the compressibility of the elastic body within a range of 2% to 7% and the A hardness thereof within a range of 45 degrees to 60 degrees. In addition, it is possible to set the compressibility of the flexible plastic sheet within the range of 2% to 65% and the A hardness thereof within the range of 5 degrees to 50 degrees. At this time, it is preferable to set the compressibility of the flexible plastic sheet within the range of 4% to 20% and the A hardness thereof within the range of 25 degrees to 35 degrees. In addition, it is preferable to set the thicknesses of both the flexible elastic sheet and the elastic body at 2.0 mm or less. The moduli of elasticity of both the flexible plastic sheet and the elastic body may be set at 60% or more. At this time, it is preferable to set the moduli of elasticity of both the flexible plastic sheet and the elastic body within the range of 85% to 100%. In addition, both the flexible plastic sheet and the elastic body may be made of polyurethane resin obtained by wet-type film formation and have foamed structures inside which foams are formed. At this time, the flexible plastic sheet and the elastic body can be joined together with a polyurethane resin solution.

According to the present invention, such effects can be obtained that, since the flexible plastic sheet has a higher compressibility and a lower A hardness than those of the elastic body and its thickness is 0.2 mm or more, and thus flexibility of the flexible plastic sheet is exerted during polishing processing, occurrence of a scratch on an object to be polished can be suppressed, and that, since the compressibility of the elastic sheet is set at 1% or more, the A hardness thereof is set at 90 degrees or less and the thickness thereof is set at 0.2 mm or more, and thus a recess or a protrusion on the surface of a surface plate on which the polishing pad is attached, if any, can be absorbed by the elastic body, and the soft flexible plastic sheet is supported by the elastic body during polishing processing so that pressure on the object to be polished is made even, occurrence of a roll-off on the object to be polished is suppressed so that flatness can be improved.

DETAILED DESCRIPTION OF THE PREFERRED EMBODIMENTS

Hereinafter, with reference to the drawings, an embodiment of a polishing pad to which the present invention has been applied will be explained.

(Polishing Pad)

Figure 1:
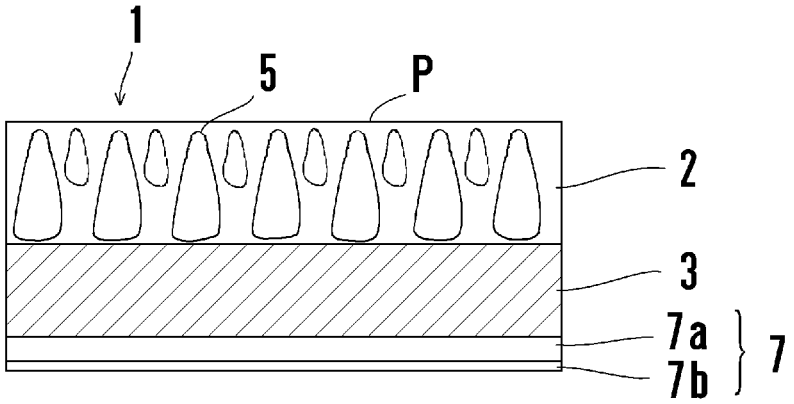
FIG. 1 is a sectional view showing a polishing pad of an embodiment to which the present invention has been applied.

As shown in FIG. 1, a polishing pad 1 of the embodiment is comprised a polyurethane sheet 2 serving as a flexible plastic sheet having a polishing surface P for performing polishing processing to an object to be polished and an elastic sheet 3 serving as an elastic body joined on a surface of the plastic sheet on the opposite side to the polishing surface P.

The polyurethane sheet 2 is formed into a sheet shape by performing wet-type film formation of polyurethane resin, and has a foamed structure inside which foams are formed. That is, the polyurethane sheet 2 has a skin layer (surface layer) in which numerous microscopic pores (not shown) are densely formed on the side of the polishing surface P, and has a foamed layer on the back side of the skin layer (on the side of the elastic sheet 3). In the foamed layer, foams 5 having larger pore diameters than the numerous microscopic pores formed in the skin layer and having rounded approximately-triangular cross sections in the thickness direction of the polyurethane sheet 2 are formed in an approximately-evenly scattered manner. The foams 5 are reduced in diameters at the side of the polishing surface P such that the pore diameters at the side of the polishing surface P are formed to be smaller than those at the opposite side to the polishing surface P. In the polyurethane resin between the foams 5, foams (not shown) which are larger in pore diameter than the numerous microscopic pores formed in the skin layer and smaller in pore diameter than the foams 5 are formed. The numerous microscopic pores (not shown) in the skin layer, the foams 5 and the foams (not shown) in the foamed layer communicate with one another via communication holes (not shown) in a three-dimensional network manner.

On the other hand, the elastic sheet 3 is formed into a sheet shape using material having elasticity, for example, resin such as polyurethane, polyethylene, polybutadiene or the like, rubber, or the like. In this example, the elastic sheet 3 that is formed into a sheet shape by performing wet-type film formation of polyurethane resin is used. In other words, the elastic sheet 3 has a foamed structure inside which foams are formed, like the polyurethane sheet 2. In addition, the elastic sheet 3 is joined to the polyurethane sheet 2 by a double-stick tape, an adhesive or the like.

A compressibility, an A hardness, a modulus of elasticity, and a thickness are set separately with respect to the polyurethane sheet 2 and the elastic sheet 3. That is, the compressibility of the polyurethane sheet 2 is set higher than that of the elastic sheet 3, and the A hardness of the polyurethane sheet 2 is set lower than that of the elastic sheet 3. The moduli of elasticity of both the polyurethane sheet 2 and the elastic sheet 3 are set at 60% or more. A compressibility, an A hardness, and a modulus of elasticity can be set within desired ranges by selecting a polyurethane resin or additives used for wet-type film formation of the polyurethane sheet 2 and the elastic sheet 3 and by adjusting the foamed structures. In this example, the compressibility of the polyurethane sheet 2 is set within a range of 4% to 65% and the A hardness thereof is set within a range of 5 to 50 degrees. On the other hand, the compressibility of the elastic sheet 3 is set at 1% or more and 25% or less, and the A hardness thereof is set at 30 degrees or more and 90 degrees or less. The moduli of elasticity of both the polyurethane sheet 2 and the elastic sheet 3 are set within a range of 60% to 100%, and the thicknesses thereof are set at 0.2 mm or more and 2.0 mm or less.

In the polishing pad 1, a double-stick tape 7 for attaching the polishing pad 1 to a polishing machine is stuck on a surface of the elastic sheet 3 on the opposite side to the polyurethane sheet 2. The double-stick tape 7 has a base material 7*a* which is a flexible film such as a film made of polyethylene terephthalate (hereinafter, abbreviated as PET) or the like, and a pressure sensitive adhesive layer of an acrylic adhesive or the like is formed on both surfaces of the base material 7*a*. The double-stick tape 7 is stuck on the elastic sheet 3 with the adhesive layer on one surface of the base material 7*a*, and the adhesive layer on the other surface (on the opposite side to the elastic sheet 3) is covered with a release paper 7*b*.

(Production of the Polishing Pad)

Figure 2:
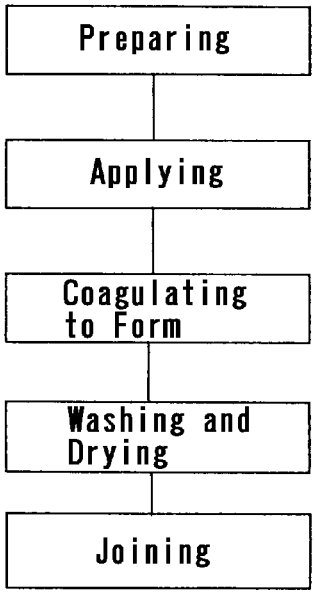
FIG. 2 is a process chart showing steps for producing the polishing pad of the embodiment.

Though the polishing pad 1 is produced through respective step shown in FIG. 2, the polyurethane sheet 2 and the elastic sheet 3 separately produced by wet-type film formation from a preparing step to a washing and drying step are joined together at a joining step. In the wet-type film formation, strip-like (long) polyurethane sheet 2 and elastic sheet 3 are produced by continuously applying polyurethane resin solution obtained by dissolving polyurethane resin in an organic solvent on a base material for film formation, immersing the base material in aqueous coagulation liquid in order to coagulate to form the polyurethane resin in a film shape, and drying them after washing. Hereinafter, respective of steps thereof will be explained in order.

At the preparing step, polyurethane resin, N,N-dimethylformamide (hereinafter, abbreviated as DMF) that is a water-miscible organic solvent which can dissolve polyurethane resin, and additives are mixed to dissolve polyurethane resin. Polyester polyurethane, polyether polyurethane, polycarbonate polyurethane or the like is selected to be used as the polyurethane resin, and is dissolved in DMF, for example, such that the percentage of polyurethane resin becomes 30%. As the additives, in order to control the size or amount (number) of the foams 5, a pigment such as carbon black, a hydrophilic activator for promoting foaming, a hydrophobic activator for stabilizing coagulation and formation of polyurethane resin, and the like can be used. After removing agglomerations by filtering a resultant solution, the solution is defoamed under vacuum to obtain a polyurethane resin solution.

At the applying step, the polyurethane resin solution prepared at the preparing step is applied approximately evenly on the strip-like film-formation base material by a knife coater under ordinary temperature. At this time, by adjusting a clearance between the knife coater and the film-formation base material, the application thickness (application quantity) of the polyurethane resin solution is adjusted. As the film-formation base material, a flexible film, a nonwoven fabric, a woven fabric or the like can be used. In the case of using the nonwoven fabric or the woven fabric, in order to suppress permeation of the polyurethane resin solution into the film-formation base material at the applying time of the polyurethane resin solution, pretreatment (filling) for immersing the nonwoven or woven fabric in water, DMF aqueous solution (mixed liquid of DMF and water) or the like in advance is performed. In the case of using the flexible film such as a PET film or the like as the film-formation base material, the pretreatment is unnecessary since it has no liquid permeability. Hereinafter, this example in which a PEF film is used as the film-formation base material will be explained.

At the coagulating to form step, the film-formation base material on which the polyurethane resin solution has been applied at the applying step is immersed in coagulation liquid mainly containing water which is a poor solvent with respect to polyurethane resin. In coagulation liquid, a skin layer having a thickness of about several micro meters is first formed at the surface side of the applied polyurethane resin solution. Thereafter, polyurethane resin is coagulated to form in a sheet shape on one surface of the film-formation base material according to progress in substitution of DMF in the polyurethane resin solution with coagulation liquid. Due to desolvation of DMF from the polyurethane resin solution and substitution of DMF with coagulation liquid, the foams 5 and the foams (not shown) are formed inside the skin layer (in polyurethane resin), and the communication holes (not shown) for communicating the foams 5 and the foams (not shown) with each other are formed in a three-dimensional network manner. At this time, since the PET film of the film-formation base material does not allow water permeation, desolvation occurs on the side of the surface (side of the skin layer) of the polyurethane resin solution, so that the foams 5 larger at the side of the film-formation base material than at the side of the surface are formed.

At the washing and drying step, the polyurethane resin which has been coagulated to form at the coagulating to form step, namely, the polyurethane sheet 2 is peeled off from the film-formation base material, and washed in washing liquid such as water so that DMF remaining in the resin is removed. After washing, the polyurethane sheet 2 is dried in a cylinder drying machine. The cylinder drying machine is provided with a cylinder having a heat source inside. The polyurethane sheet 2 passes around the peripheral surface of the cylinder to be dried. The resin which has been formed in a film shape after dried is rolled up.

Next, the production of the elastic sheet 3 will be explained, but explanations about steps and conditions identical to those in above described production of the polyurethane sheet 2 will be omitted and only different steps will be explained.

At the preparing step, polyurethane resin, DMF, additives, and adjustment organic solvent for foaming adjustment are blended. After polyurethane resin has been dissolved by mixing polyurethane resin, DMF, and additives, in order to delay substitution of DMF with water at the coagulating to form time, a predetermined amount of the adjustment organic solvent is added to obtain resin emulsion. As the adjustment organic solvent, one which is smaller in solubility in water than DMF, which does not cause the polyurethane resin dissolved in DMF to coagulate (gelate), and which can be mixed or dispersed evenly in the solution in which polyurethane resin has been dissolved is used. As a specific example, ethyl acetate, isopropyl alcohol or the like can be cited. By changing the additive amount of the adjustment organic solvent, the size or amount (number) of foams formed inside the elastic sheet 3 can be controlled, and thus the compressibility of the elastic sheet 3 can be adjusted. In this example, in order to set the elastic sheet 3 lower in compressibility and higher in A hardness than those of the polyurethane sheet 2, it is preferable to set the additive amount of the adjustment organic solvent within the range of 20 to 45 parts relative to 100 parts of the resin emulsion.

At the coagulating to form step, the film-formation base material on which the resin emulsion has been applied is immersed in coagulation liquid so that polyurethane resin is coagulated to form. In coagulation liquid, a skin layer is first formed on the surface side of the resin emulsion, however, since the adjustment organic solvent has been added in the resin emulsion, development of substitution of DMF with the adjustment organic solvent in the resin emulsion and coagulation liquid is made slow. Therefore, foams which are smaller in average pore diameter than the foams 5 formed in the polyurethane sheet 2 and larger in average pore diameter than the numerous microscopic pores formed in the skin layer are formed approximately evenly inside the skin layer formed on the surface side.

Here, the formation of the foams 5 in the polyurethane sheet 2 and the foams in the elastic sheet 3 will be explained. DMF used for dissolving polyurethane resin is a solvent ordinarily used for dissolving polyurethane resin, and can be mixed in water at an arbitrary ratio. Therefore, in production of the polyurethane sheet 2, when the polyurethane resin solution is immersed in coagulation liquid, substitution of DMF with coagulation liquid (coagulation for formation of polyurethane resin) first occurs on the surface side of the polyurethane resin solution, so that the skin layer is formed. Thereafter, since coagulation liquid penetrates the polyurethane resin solution from where coagulation liquid easily penetrates in the skin layer, the substitution of DMF with coagulation liquid develops rapidly in some portions and delays in other portions, so that the comparatively-large foams 5 are formed. Since a PET film which does not allow coagulation liquid to permeate is used as the film-formation base material, DMF is eluted only from the side of the surface (side of the skin layer) of the polyurethane resin solution, so that the foam 5 is formed in a rounded cone shape which is larger at the side of the film-formation base material.

On the other hand, in the production of the elastic sheet 3, the adjustment organic solvent is added after polyurethane resin has been dissolved to obtain the resin emulsion. Since the adjustment organic solvent is lower in solubility in water than DMF, it is eluted into water (coagulation liquid) more slowly than DMF. In addition, the amount of DMF is less in the resin emulsion by the additional amount of the adjustment organic solvent. Therefore, since the speed of substitution of DMF with the adjustment organic solvent and coagulation liquid becomes slower, the formation of the foams 5 such as in the polyurethane sheet 2 is suppressed, and thus the foams which is smaller than the foams 5 and larger than the numerous microscopic pores in the skin layer are formed in an approximately-evenly dispersed manner inside the skin layer of the elastic sheet 3. In addition, in the elastic sheet 3, since foams are formed in accordance with desolvation of DMF and the adjustment organic solvent, the foams are caused to communicate with one another in a three-dimensional network manner via the communication holes which are smaller than the pore diameters of the formed foams.

As shown in FIG. 2, at the joining step, the elastic sheet 3 is joined on a surface of the polyurethane sheet 2 on the opposite side to the skin layer of the polyurethane sheet 2. For the joining, a pressure sensitive adhesive such as acrylic adhesive is used. Incidentally, the elastic sheet 3 is joined on its surface on which the skin layer has been formed. The double-stick tape 7 is stuck on the other surface of the elastic sheet 3 on the opposite side to the polyurethane sheet 2 by using the adhesive layer on one side. Then, after having been cut into a desired shape such as a circular shape or the like, the polishing pad 1 is subjected to an examination such as a confirmation that there is no dirt or foreign matter attached in order to complete the polishing pad 1.

When polishing processing is performed to an object to be polished by the resultant polishing pad 1, for example, the polishing pads 1 are attached to both an upper surface plate and a lower surface plate of a double-sided polishing machine. When the polishing pad 1 is attached, the adhesive layer of the double-stick tape 7 is stuck by removing the release paper 7*b*. In the polishing pads 1 stuck on the upper surface plate and the lower surface plate, both the polishing surfaces P are approximately flat. An object to be polished is sandwiched between the approximately-flat polishing surfaces P of the two polishing pads 1 and both surfaces of the object to be polished are simultaneously subjected to polishing processing. At this time, polishing liquid (slurry) including polishing particles is supplied.

(Effect)

Next, effect and the like of the polishing pad 1 of the embodiment will be explained.

In the polishing pad 1 of the embodiment, the compressibility of the polyurethane sheet 2 is set higher than that of the elastic sheet 3 and the A hardness of the polyurethane sheet 2 is set lower than that of the elastic sheet 3. In other words, the polyurethane sheet 2 is larger in amount of deformation with respect to external force than the elastic sheet 3, and thus the polyurethane sheet 2 is more flexible than the elastic sheet 3. Therefore, the flexibility of the polyurethane sheet 2 is exerted during polishing processing, so that occurrence of a scratch on an object to be polished can be suppressed.

In addition, in the polishing pad 1 of the embodiment, the thickness of the polyurethane sheet 2 is set at 0.2 mm or more and 2.0 mm or less. If the thickness is less than 0.2 mm, the flexibility is not sufficiently exerted during polishing processing, and thus there is the possibility that a scratch is likely to occur on an object to be polished. On the other hand, if the thickness is more than 2 mm, wet-type film formation is difficult to perform. Therefore, by setting the thickness of the polyurethane sheet 2 within the above-described range, the flexibility can sufficiently be exerted during polishing processing, so that occurrence of a scratch on an object to be polished can be suppressed.

Further, in the polishing pad 1 of the embodiment, since the elastic sheet 3 is joined to the polyurethane sheet 2, due to the fact that the amount of deformation with respect to external force of the elastic sheet 3 is smaller than that of the polyurethane sheet 2, the flexible polyurethane sheet 2 is supported by the elastic sheet 3 so that the elasticity of the polyurethane sheet 2 is suppressed. Therefore, since the polishing surface P is pressed approximately evenly onto the whole surface to be polished of an object to be polished while the polyurethane sheet 2 deforms, occurrence of a roll-off that the peripheral edge portion of the polished surface of the object to be polished is excessively subjected to the polishing processing more than the central portion thereof is suppressed.

Furthermore, in the polishing pad 1 of the embodiment, since the elastic sheet 3 is an elastic body, even if a recess or a protrusion caused by a scratch or the like is formed on the surface of a surface plate of the polishing machine, it can be absorbed by the elastic sheet 3. Thereby, it is made possible to suppress lowering in flatness of an object to be polished due to a transfer of a recess or a protrusion on the surface plate to the object to be polished. In addition, the elastic sheet 3 is formed to have a thickness of 0.2 mm or more and 2.0 mm or less. If the thickness is less than 0.2 mm, the elastic sheet 3 cannot absorb a recess or a protrusion on the surface plate, and thus the influence of the recess or protrusion appears on the processed surface of an object to be polished to damage the flatness. On the other hand, if the thickness is larger than 2 mm, it is difficult to press the polyurethane sheet 2 approximately evenly, and thus a roll-off is rather increased. Therefore, by setting the thickness of the elastic sheet 3 within the above-described range, a recess or a protrusion on a surface plate can be reliably absorbed, and thus the flatness of an object to be polished is improved.

Furthermore, in the polishing pad 1 of the embodiment, the compressibility of the elastic sheet 3 is set at 1% or more and 25% or less, and the A hardness thereof is set at 30 degrees or more and 90 degrees or less. If the compressibility is less than 1% or the A hardness is more than 90 degrees, the elastic sheet 3 is too hard, and thus the influence of the hardness appears on the processed surface of an object to be polished. That is, since a recess, a protrusion or the like on the surface plate is not absorbed by the elastic sheet 3, and thus it the influence thereof appears on the processed surface, there is the possibility that the flatness of an object to be polished is lowered. On the other hand, if the compressibility is more than 25% or the A hardness is less than 30 degrees, the elastic sheet 3 is too flexible, and thus it is difficult to support the polyurethane sheet 2 or reduce a roll-off.

In addition, in the polishing pad 1 of the embodiment, the compressibility of the polyurethane sheet 2 is set within the range of 2% to 65%, and the A hardness thereof is set within the range of 5 to 50 degrees. If the compressibility is less than 2% or the A hardness is more than 50 degrees, the polyurethane sheet 2 is so hard that it is difficult to deform during polishing processing, and thus a scratch is likely to occur on an object to be polished. On the other hand, if the compressibility is more than 65% or the A hardness is less than 5 degrees, the polyurethane sheet 2 is too flexible, and thus not only is the efficiency of polishing processing reduced, but also the flatness of an object to be polished is damaged.

Further, in the polishing pad 1 of the embodiment, the moduli of elasticity of both the polyurethane sheet 2 and the elastic sheet 3 are set within the range of 60% to 100%. Therefore, even if the polyurethane sheet 2 and the elastic sheet 3 are deformed during polishing processing, they almost return to their original shapes, so that the polishing pad 1 can repeatedly be used in polishing processing, and thus the polishing pad 1 can be long-lived.

Incidentally, in the embodiment, the polyurethane sheet 2 and the elastic sheet 3 that are polyurethane resin formed into sheet shapes by wet-type film formation are illustrated, but the present invention is not limited thereto. As the polyurethane sheet 2, for example, a flexible resin having plasticity such as polyethylene resin or the like formed in a sheet shape may be used. In addition, as the elastic sheet 3, for example, a material having elasticity such as a resin such as polyethylene, polybutadiene or the like, or natural rubber, synthetic rubber or the like formed in a sheet shape may be used. A method for formation into a sheet shape is also not limited to the wet-type film formation, and dry-type film formation can be employed. In view of setting the compressibility or the A hardness of the polyurethane sheet 2 within the above-described range, it is preferable to employ wet-type film formation. In addition, in the embodiment, such an example has been provided that the compressibility of the elastic sheet 3 is set lower than that of the polyurethane sheet 2 and the A hardness of the elastic sheet 3 is set higher than that of the polyurethane sheet 2 by adding the adjustment organic solvent in the production of the elastic sheet 3, but the present invention is not limited thereto. For example, blending of additives and the like may be adjusted in wet-type film formation of the polyurethane sheet 2, or materials may be changed.

In addition, in the embodiment, such an example that the compressibility of the polyurethane sheet 2 is set within the range of 2% to 65% and the A hardness thereof is set within the range of 5 to 50 degrees has been provided. In view of securing the flexibility of the polyurethane sheet 2 to suppress occurrence of a scratch on an object to be polished, it is preferable to set the compressibility within the range of 2% to 40%. Further, in view of polishing efficiency or flatness improvement of an object to be polished, it is more preferable to set the compressibility within the range of 3% to 30%, and it is most preferable to set it within the range of 4% to 20%. Similarly, in view of securing flexibility and suppressing occurrence of a scratch, it is also preferable to set the A hardness within the range of 10 to 45 degrees. Further, in view of polishing efficiency or flatness improvement, it is more preferable to set the A hardness within the range of 15 to 40 degrees, and it is most preferable to set it within the range of 25 to 35 degrees.

Further, in the embodiment, such an example that the compressibility of the elastic sheet 3 is set at 1% or more and 25% or less and the A hardness thereof is set at 30 degrees or more and 90 degrees or less has been provided. In view of absorbing a recess, a protrusion or the like on a surface plate to improve the flatness of an object to be polished and supporting the polyurethane sheet 2 to reduce the roll-off of the object to be polished, it is preferable to set the compressibility within the range of 1% to 20%. Further, in order not to make the elastic sheet 3 too hard or too flexible to achieve a reduction in roll-off and an improvement in flatness with a proper balance, it is more preferable to set the compressibility within the range of 1% to 15%, and it is most preferable to set it within the range of 2% to 7%. Similarly, in view of improving the flatness and reducing the roll-off, it is also preferable to set the A hardness within the range of 35 to 80 degrees. Further, it is more preferable to set the A hardness within the range of 40 to 70 degrees, and it is most preferable to set it within the range of 45 to 60 degrees.

Furthermore, in the embodiment, such an example that the moduli of elasticity of both the polyurethane sheet 2 and the elastic sheet 3 are set within the range of 60% to 100% has been provided. If the moduli of elasticity thereof are set within this range, the polyurethane sheet 2 and the elastic sheet 3 almost return to their original shapes after polishing processing even if they are deformed, and thus the polishing pad 1 can repeatedly be used for polishing processing. In order to extend a repeatedly-usable period, namely, to achieve a further long-lived polishing pad, it is preferable to set the moduli of elasticity within the range of 70% to 100%, and most preferable to set it within the range of 85% to 100% so that the polyurethane sheet 2 and the elastic sheet 3 are easily restored.

Furthermore, in the embodiment, such an example that an adhesive is used for joining the polyurethane sheet 2 and the elastic sheet 3 together has been provided, but the present invention is not limited thereto. For example, when the polyurethane sheet 2 and the elastic sheet 3 are both made of polyurethane resin, like the embodiment, they can be joined together by using a solution obtained by dissolving a small amount of polyurethane resin in DMF. Alternatively, only DMF is enough to join them by pressing since polyurethane on the joined surfaces of the polyurethane sheet 2 and the elastic sheet 3 are dissolved by DMF. Alternatively, the polyurethane sheet 2 and the elastic sheet 3 may be joined together by softening the surfaces thereof to be joined by heating.

EXAMPLE

Hereinafter, an example of the polishing pad 1 produced according to the embodiment will be explained. Incidentally, polishing pads as comparative examples produced for comparison will be described together.

Example 1

In a first example, polyester MDI (diphenylmethane diisocyanate) polyurethane resin was used as polyurethane resin for production of the polyurethane sheet 2 and the elastic sheet 3. In production of the polyurethane sheet 2, a polyurethane resin solution was prepared by adding and mixing 45 parts of DMF as a solvent, 40 parts of DMF dispersion liquid including 30% of carbon black as a pigment, and 2 parts of hydrophobic activator as a film formation stabilizer with respect to 100 parts of 30% of polyurethane resin solution. On the other hand, in production of the elastic sheet 3, a resin emulsion was prepared in the same manner as the preparation of the polyurethane resin solution by further adding 45 parts of ethyl acetate as an adjustment organic solvent. The washing after coagulation for formation was performed with warm water in order to enhance a washing effect at the washing step. The polyurethane sheet 2 and the elastic sheet 3 were joined together and the double-stick tape 8 was stuck on the elastic sheet 3, so that the polishing pad 1 of the example 1 was produced.

Comparative Example 1

In a comparative example 1, a polishing pad of the comparative example 1 was produced by joining two polyurethane sheets 2 produced in the example 1 and sticking the double-stick tape 8 thereto. That is, the polishing pad of the comparative example 1 has a two-layer structure, but the polyurethane sheets 2 that are the same in compressibility and in A hardness are joined together.

Comparative Example 2

In a comparative example 2, a polishing pad of the comparative example 2 was produced by joining two elastic sheets 3 produced in the example 1 and sticking the double-stick tape 8 thereto. That is, the polishing pad of the comparative example 2 has a two-layer structure, but the elastic sheets 3 that are lower in compressibility and higher in A hardness than the polyurethane sheets 2 are joined together.

(Evaluation of Properties)

Values of respective properties of thickness, compressibility, modulus of compression elasticity, and A hardness with respect to the polyurethane sheet 2 and the elastic sheet 3 used in the polishing pads of the respective example and comparative examples were measured. Measurement of thickness was performed by using a dial gauge (the minimum scale of 0.01 mm) and applying a load of 100 g/cm$^2$. 1 m vertical×1 m horizontal polyurethane sheet 2 and elastic sheet 3 were gauged down to a tenth of the minimum scale (0.001 mm) by 10-centimeter vertical and horizontal pitch to obtain average values and standard deviations σ of the thicknesses. A compressibility and a modulus of compression elasticity were obtained by using a Schopper thickness gauge (pressurizing surface: circular surface of 1 cm in diameter) according to Japanese Industrial Standards (JIS L 1021). Specifically, a thickness $t_0$ after pressurized for 30 seconds with initial load was measured, and then a thickness $t_1$ after left for 5 minutes under final pressure was measured. After left for 5 minutes with the whole load removed, a thickness $t_0'$ after pressurized for 30 seconds with initial load was measured again. A compressibility was calculated using the equation: compressibility (%)=$(t_0-t_1)/t_0\times100$, and a modulus of compression elasticity was calculated using the equation: modulus of compression elasticity (%)=$(t_0'-t_1)/(t_0-t_1)\times100$. At this time, the initial load was 100 g/cm$^2$, and the final pressure was 1120 g/cm$^2$. An A hardness was obtained based upon the indentation depth of an indenter pressed onto the surface of a test piece via a spring according to Japanese Industrial Standards (JIS K 6253). The measurement results of a thickness, a compressibility, a modulus of compression elasticity, and an A hardness are shown in the following Table 1.

TABLE 1

| | Sheet thickness (mm) | | Compressibility (%) | Modulus of compression elasticity (%) | A hardness (degree) |
|---|---|---|---|---|---|
| | Average | Standard Deviation σ | | | |
| Polyurethane sheet 2 | 0.503 | 0.007 | 14.0 | 96.1 | 28.5 |
| Elastic sheet 3 | 0.496 | 0.008 | 3.7 | 93.0 | 55.7 |

As shown in the Table 1, the polyurethane sheet 2 showed an average value of thicknesses of 0.503 mm, and showed a standard deviation σ of thicknesses of 0.007 mm. In addition, the polyurethane sheet 2 showed a compressibility of 14.0%, a modulus of compression elasticity of 96.1%, and an A hardness of 28.5 degrees. On the other hand, the elastic sheet 3 showed an average value of thicknesses of 0.496 mm, and showed a standard deviation σ of thicknesses of 0.008 mm. In addition, the elastic sheet 3 showed a compressibility of 3.7%, which was lower than that of the polyurethane sheet 2, and an A hardness of 55.7 degrees, which was higher than that of the polyurethane sheet 2. The elastic sheet 3 showed a modulus of compression elasticity of 93.0%, which is approximately the same as that of the polyurethane sheet 2. From the results, it was confirmed that the polyurethane sheet 2 had a higher compressibility and a lower A hardness than the elastic sheet 3, the elastic sheet 3 was 1% or more in compressibility and 90 degrees or less in A hardness, and both the polyurethane sheet 2 and the elastic sheet 3 were 0.2 mm or more in thickness.

(Evaluation of Polishing Performance)

Next, polishing processing was performed to an aluminum substrate for a hard disk under the following conditions by using the polishing pads of the respective example and comparative examples to evaluate their polishing performances based upon a polishing removal rate, a roll-off, and an occurrence state of a scratch. A polishing removal rate indicated a polishing amount per minute with a thickness, and was calculated from a polishing amount obtained from a weight reduction of the aluminum substrate between before and after polishing processing, and a polished area and a specific gravity of the aluminum substrate. A roll-off occurs due to polishing processing performed excessively on the peripheral edge portion of the aluminum substrate more than on the central portion thereof, and is one of measurement items for evaluating flatness. As a measuring method, for example, an optical surface roughness meter is used to obtain a two-dimensional profile image within a range of 2 mm in a radial direction from a position of 0.3 mm from an outer peripheral end portion toward the center. The obtained two-dimensional profile image is subjected to leveling correction such that, when the radial direction is an X-axis and the thickness direction is a y-axis, the value of y-axis is Y=0 at coordinate positions of x=0.5 mm and x=1.5 mm from the outer peripheral end portion, and a PV value between x=0.5 mm to x=1.5 mm of the two-dimensional profile image obtained at this time is indicated as a roll-off in nanometer unit. When an object to be polished is a 3.5-inch aluminum substrate, a PV value between 46 to 47 mm in radius is obtained. For measurement of a roll-off, a surface roughness meter (produced by ZYGO Corporation, Product No. New View 5022) was used. Regarding the occurrence state of a scratch, presence or absence of a scratch was determined by observing the surface of the aluminum substrate after polishing processing with a microscope. The measurement results of a polishing removal rate, a roll-off, and presence or absence of a scratch are shown in the following Table 2.

(Polishing Conditions)

Used polishing machine: 9B-5P Polishing Machine, manufactured by SpeedFam Company Limited Polishing speed (number of rotations): 30 rpm Processing pressure: 100 g/cm$^2$ Slurry: Colloidal silica slurry Supplied amount of slurry: 100 cc/min Object to be polished: Aluminum substrate for a hard disk (95 mmϕ in outer diameter, 25 mm in inner diameter, 1.27 mm in thickness)

TABLE 2

| | Polishing removal rate (μm/min) | Roll-off (nm) | Presence or absence of scratch |
|---|---|---|---|
| Example 1 | 0.162 | 1.2 | Absent |
| Comparative example 1 | 0.166 | 13.1 | Absent |
| Comparative example 2 | 0.124 | 1.8 | Present |

As shown in the Table 2, in the polishing pad of the comparative example 1 in which polyurethane sheets 2 were joined together, due to deformation of the polyurethane sheets 2 caused by deformation of the foams 5, the polishing removal rate showed 0.166 μm/min, no scratch was found, but the roll-off that indicates flatness was 13.1 nm, which was bad. Further, in the polishing pad of the comparative example 2 in which the elastic sheets 3 were joined together, due to a high A hardness (see the Table 1, too), the polishing removal rate showed 0.124 μm/min, the roll-off was 1.8 nm, which was good, but a scratch was found. On the other hand, in the polishing pad 1 of the example 1 in which the polyurethane sheet 2 and the elastic sheet 3 were joined together, the polishing removal rate showed 0.162 μm/min, which was a value close to that in the comparative example 1. In addition, the roll-off was 1.2 nm, which was better than that in the comparative example 1. This can be attributed to the fact that deformation of the foams 5 and therefore deformation of the polyurethane sheet 2 was suppressed since the polyurethane sheet 2 was joined to the elastic sheet 3. From the above, it was found that the polishing pad 1 which could achieve excellent polishing characteristics could be obtained by joining the elastic sheet 3 to the polyurethane sheet 2.

INDUSTRIAL APPLICABILITY

Since the present invention provides a polishing pad which can suppress occurrence of a scratch or a roll-off on an object to be polished so that flatness is improved, it contributes to manufacture and sale of polishing pads, and thus it has industrial applicability.

What is claimed is:

1. A polishing pad, comprising: a flexible plastic sheet having a skin layer on a side of a polishing surface for performing polishing processing to an object to be polished, the skin layer being formed of a same composition as the flexible plastic sheet; and an elastic body joined on a surface of the flexible plastic sheet on the opposite side to the polishing surface, wherein both the flexible plastic sheet and the elastic body have foamed structures inside which foams are formed by wet-type film formation, and wherein the flexible plastic sheet has a higher compressibility and a lower A hardness than those of the elastic body, and the elastic body is 1% or more in compressibility and 90 degrees or less in A hardness, and wherein both the flexible plastic sheet and the elastic body are 0.2 mm or more in thickness, the flexible plastic sheet is within a range of 2% to 65% in compressibility and is within a range of 5 degrees to 50 degrees in A hardness.

2. The polishing pad according to claim 1, wherein the elastic body is from 1% to 25% in compressibility and is from 30 degrees to 90 degrees in A hardness.

3. The polishing pad according to claim 1, wherein both the flexible plastic sheet and the elastic body are from 0.2 mm to 2.0 mm in thickness.

4. The polishing pad according to claim 1, wherein both the flexible plastic sheet and the elastic body are 60% or more in modulus of elasticity.

5. The polishing pad according to claim 4, wherein both the flexible plastic sheet and the elastic body are within the range of 85% to 100% in modulus of elasticity.

6. The polishing pad according to claim 1, wherein both the flexible plastic sheet and the elastic body are made of polyurethane resin.

7. The polishing pad according to claim 6, wherein both the flexible plastic sheet and the elastic body are joined together with a polyurethane resin solution.

8. The polishing pad according to claim 1, wherein the flexible plastic sheet is within the range of 4% to 20% in compressibility and is within the range of 25 degrees to 35 degrees in A hardness.

9. A polishing pad, comprising: a flexible plastic sheet having a skin layer on a side of a polishing surface for performing polishing processing to an object to be polished, the skin layer being formed of a same composition as the flexible plastic sheet; and an elastic body joined on a surface of the flexible plastic sheet on the opposite side to the polishing surface, wherein both the flexible plastic sheet and the elastic body have foamed structures inside which foams are formed by wet-type film formation, and wherein the flexible plastic sheet has a higher compressibility and a lower A hardness than those of the elastic body, and wherein both the flexible plastic sheet and the elastic body are 0.2 mm or more in thickness, and wherein the elastic body is within the range of 2% to 7% in compressibility and is within the range of 45 degrees to 60 degrees in A hardness.

* * * * *